United States Patent [19]

Shawn et al.

[11] 4,029,203

[45] June 14, 1977

[54] MATCH BOOK

[76] Inventors: Nelson G. Shawn, 8406 Hollywood Blvd., Los Angeles, Calif. 90069; Anthony L. Gabrio; Iris G-S Gabrio, both of 348 N. Windsor Blvd., Los Angeles, Calif. 90004

[22] Filed: Feb. 26, 1976 (Under Rule 47)

[21] Appl. No.: 661,659

[52] U.S. Cl. ..... 206/108; 206/106; 206/109

[51] Int. Cl.[2] ..... A24F 27/18; A24F 27/00; A24F 27/12

[58] Field of Search ..... 206/109, 106, 107, 108, 206/110, 111, 112

[56] References Cited

UNITED STATES PATENTS

| | | | |
|---|---|---|---|
| 2,217,854 | 10/1940 | Baldwin | 206/109 |
| 2,935,184 | 5/1960 | Olson | 206/109 |

*Primary Examiner*—William T. Dixson, Jr.
*Attorney, Agent, or Firm*—William W. Haefliger

[57] ABSTRACT

A child-resistant match book incorporates abrasive ignition material within a slot formed by a fold. The slot has open ends, but the abrasive material extends remotely from the right end of the slot, the book oriented with the flap facing the user.

5 Claims, 7 Drawing Figures

MATCH BOOK

BACKGROUND OF THE INVENTION

This invention relates generally to match books, or folders and more particularly concerns a safer book resistant to manipulation by a child to achieve striking of a match; further, the book or folder is so designed as to enable its production using existing equipment.

While others in the past have developed various match book construction employing similar concealment of the head ignition material, none have provided the unusually effective "decoy" techniques of book construction and mode of operation as are now facilitated by the present invention. Such prior designs are exemplified by those in U.S. Pat. Nos. 1,459,033; 1,849,432; 2,217,854; and 2,935,184.

SUMMARY OF THE INVENTION

It is a major object of the invention to provide a match book or folder which substantially increases the difficulty of inadvertent usage or manipulation by a child with consequent danger of serious burns and/or fire. Basically, the book is embodied in the combination that includes:

a. a parallel match cluster having friction ignitable heads b. protective cover means for the cluster and defining a fold attached to the cluster remotely from said heads, the cover means including a back and a front flap attached thereto to extend over the heads and toward the fold for releasable retention thereby, and c. said fold defining a transverse through slot having a left end opening and a right end opening relative to the book when viewed frontally toward said front flap, d. and abrasive ignition material bonded to at least one inner surface of the fold extending transversely between said left end opening and a locus proximate the medial portion of the slot, the inner surfaces of the slot extending between said locus and the right end opening being substantially free of said material, whereby a match head may be ignited only after insertion into said fold via said left end opening, and withdrawal from said slot via said left end opening accompanied by pressural contact with said material.

As will appear the ignition material may be bonded to one or both inner sides of the lower fold; the band or bands of material typically extend only about five-eighths of the distance from the left to the right end openings of the slot defined by the lower fold; and the ignitable head may be formed on only one side of a match stick when the ignition material is bonded to only one inner side of the fold.

These and other objects and advantages of the invention, as well as the details of an illustrative embodiment, will be more fully understood from the following description and drawings, in which:

DRAWING DESCRIPTION

Figure 5A:
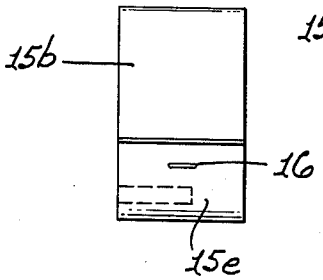
Figure 5B:
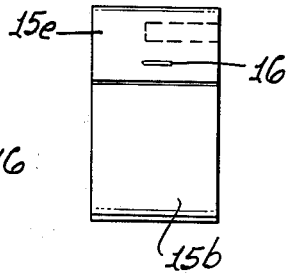
Figure 5C:
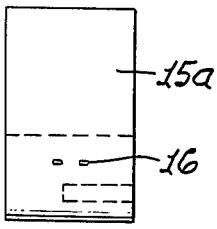

FIGS. 5*a*–5*c* are views showing different book positions.

DETAILED DESCRIPTION

In FIGS. 1–4, the illustrated match book 10 includes a parallel cluster 11 of individual matches 12. The latter may consist of cardboard extending upwardly from an integral cardboard base 13 which extends transversely between opposite edges of the book. The matches have conventional friction ignitable heads 14, as shown.

Protective cover means 15 is provided for the match cluster, and may consist of cardboard (or the like) having a back **15*a* and a front flap 15*b* attached to the back at the upper fold location 15*c* to extend over the match heads. The cover means also includes a lower back portion 15*d* and a lower front portion 15*e* which are integrally connected as at lower location 15*f*. The portions 15*d*, 15*e*, and 15*f* define a lower fold which is effectively attached to the cluster remotely from the match heads. For example, at least one fastener, such as staple 16, may extend through and attach the portions 15*d* and 15*e* to the base 13**, which lays flatly therebetween.

Figure 1:
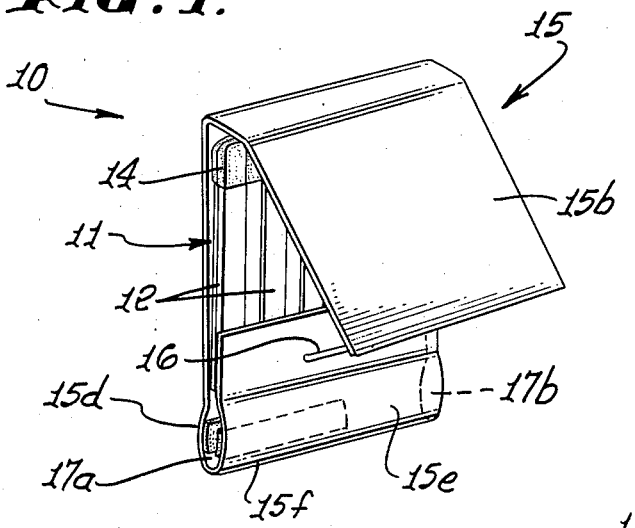
FIG. 1 is a perspective view showing a match book embodying the invention.

The lower fold defines a transverse through slot 17 having a left end opening **17*a* and a right end opening 17*b*, relative to the book, when viewed frontally toward the front flap, as in FIG. 1**.

Figure 2:
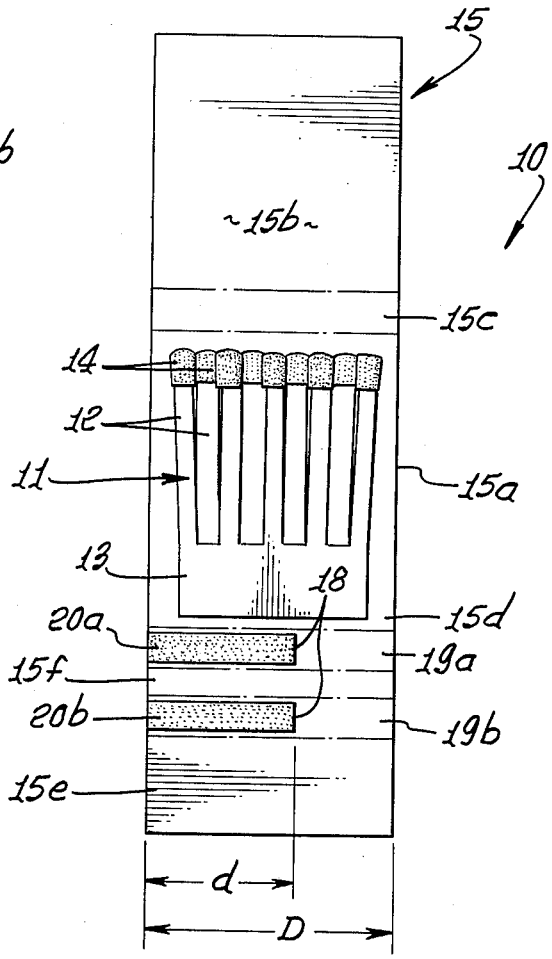
FIG. 2 is a frontal elevation showing the FIG. 1 book prior to complete assembly.
Figure 3:
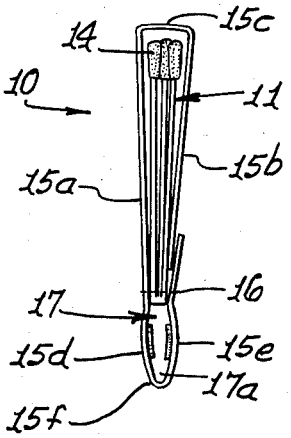
FIG. 3 is a left end view of the FIG. 1 book.
Figure 4:
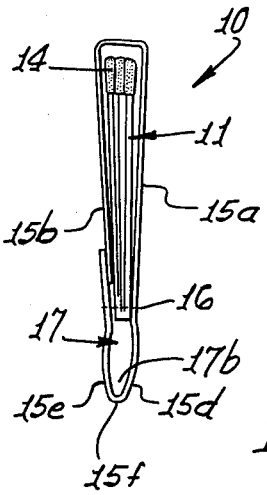
FIG. 4 is a right end view of the FIG. 1 book.

In accordance with the invention, abrasive ignition material is bonded or otherwise attached to at least one inner surface of the lower fold and extended transversely between the left end opening **17*a* a locus 18 proximate the medial portion of the slot; in this regard, one or both bonds 20*a* and 20*b*** of material may be used and for best results extend for a distance *d* which is about five-eighths of the distance D from the left end opening toward the right end opening, as best seen in FIG. 2. Further, the inner surfaces **19*a* and 19*b* of the slot extending between the locus 18 and the right end opening 17*b* are substantially and preferably completely free of such ignition material, whereby insertion of a match into decoy opening 17*b* will not result in ignition when the match is withdrawn. As a result, a match head may be ignited only after insertion into the fold via the left end opening 17*a*, followed by withdrawal from the slot via the opening 17*a* accompanied by pressural contact with the friction material. Such contact is effected by squeezing the fold to narrow the slot and press one or both bands 20*a* and 20*b*** against the match head.

For a right-handed person, the sequence involves retrieving a match from the book while viewing the book frontwardly toward cover 15; turning the book 180° from FIG. **5*a* position to either FIG. 5*b* or 5*c* position to bring opening 17*a* to the right side of the book; inserting the match in the slot via opening 17*a*; and withdrawing the match while squeezing the fold. In FIG. 5*b*, the book has been inverted 180° while the cover 15*b* remains facing the viewer; whereas, in FIG. 5*c* the book has been turned over so that the back 15*a*** faces the viewer.

For a right handed child unfamiliar with the above total sequence, it is considered substantially less likely that he would be able to successfully ignite a match than if the ignition material extended into proximity to the opening **17*b*** so that he did not have to rotate or invert the book to achieve ignition.

We claim:

1. In a match book resistant to right-handed children, the combination comprising a. a parallel match cluster having friction ignitable heads b. protective cover means for the cluster and defining a fold attached to the cluster remotely from said heads, the cover means including a back and a front flap attached thereto to extend over the heads and toward the fold for releasable retention thereby, and c. said fold defining a transverse through slot having a left end opening and a right end opening relative to the book when viewed frontally toward said front flap, d. and abrasive ignition material bonded to at least one inner surface of the fold extending transversely between said left end opening and a locus proximate the medial portion of the slot, all inner surfaces of the slot extending between said locus and the right end opening being entirely free of said material defining a decoy slot extent therebetween, said decoy slot extent being open to receive a match head inserted from the right end of the slot, whereby a match head may be ignited only after insertion into said fold via said left end opening, and withdrawal from said slot via said left end opening accompanied by pressural contact with said material.

2. The combination of claim 1 wherein material is bonded to opposed inner surfaces of the fold, said surfaces extending between said left end opening and said locus.

3. The combination of claim 1 wherein said cover means comprises one continuous sheet of cardboard or the like defining said front flap, cover and fold, the fold receiving the match cluster terminal remotely from said heads and there being at least one fastener attaching the fold to the cluster whereby said slot extends adjacent the cluster terminal.

4. The combination of claim 1 wherein said abrasive material is located at one inner side of the slot.

5. The combination of claim 3 wherein said locus is about five-eighths of the distance from said left end opening toward the right end opening.

* * * * *